United States Patent [19]

Villarreal

[11] Patent Number: 4,553,703

[45] Date of Patent: Nov. 19, 1985

[54] MACHINE AND PROCESS FOR GRINDING GRANULAR PARTICLES

[76] Inventor: Raul M. Villarreal, Privada Cervantes #150 Col., Obispado Monterrey, N. L. 64010, Mexico

[21] Appl. No.: 582,814

[22] Filed: Feb. 23, 1984

[51] Int. Cl.[4] ..... B02C 19/00

[52] U.S. Cl. ..... 241/24; 241/26; 241/200; 241/284

[58] Field of Search ..... 241/24, 29, 79.1, 152 A, 241/166, 167, 200, 26, 284

[56] References Cited

U.S. PATENT DOCUMENTS

| | | | |
|---|---|---|---|
| 1,360,996 | 12/1920 | Anderson et al. | 241/200 |
| 2,145,330 | 1/1939 | Anderson | 241/200 |
| 2,281,860 | 5/1942 | Renault | 241/200 X |
| 2,796,198 | 6/1957 | Weigel et al. | 241/200 X |
| 2,917,245 | 12/1959 | Polleys | 241/200 X |
| 3,341,899 | 9/1967 | Marriner | 241/200 X |
| 3,878,995 | 4/1975 | Nash | 241/79.1 |
| 4,418,871 | 12/1983 | Powell | 241/79.1 X |

OTHER PUBLICATIONS 66219, 12-1982, European Patent Application.

*Primary Examiner*—Mark Rosenbaum
*Attorney, Agent, or Firm*—Laurence R. Brown

[57] ABSTRACT

A grinding process and machine for granular particles comprising two flexible continuously moveable belts which form a cavity separated apart a critical distance. The granular particles rub against each other when the belts relatively moving at different speeds grind the materials to achieve a predetermined condition.

6 Claims, 8 Drawing Figures

15
16
17
18
19
22
23
24
26
28
29
31'
32'
40
41
44
51
52
53
54
55
56
57
58
59
61
63
A
A'
B
B'
D
D'

MACHINE AND PROCESS FOR GRINDING GRANULAR PARTICLES

TECHNICAL FIELD

This invention relates to grinding granular particles and more particularly it relates to a conveyor belt assembly system which provides a cavity between two opposed flexible continuously moveable belts. The belts are spaced apart a critical distance to cause the granular particles to rub against each other as the material is transported between the belts.

BACKGROUND ART

Cleaning granular particles requires separating the desired end product from the variety of component parts, contained in the material. For example, grains when harvested are often covered with dirt and other materials. Silica sand, used as a molding media in the foundry industry becomes contaminanted with additives; and minerals, such as clay feldspar are mixed with a variety of other elements. Further, the outer surface of some grains and nuts, such as rice and pecans, requires removal. To use or reclaim the desired end product, a grinding process is utilized.

I have invented a machine and process for grinding particulate materials by introducing the material to be to be processed between two flexible continuously moveable belts. The belts circumscribe the granular particles allowing the material to be rotated and transported alongthe lengths of the belts. No spillage occurs and sufficient tension may be applied to each belt to result in the rotating action which dislodges the particles from the predetermined end product.

Generally, the process for obtaining or reclaiming the desired end product involves complex, metal machinery including mechanical grinders, rotary drums, disks, screw mechanisms, screens, metal scrub brushes and the like. Often times, water and/or chemicals are used as part of the recovery process. The force exerted by these processes results in damage to the product to be recovered, resulting in less than optimal recovery, and costly damage to the equipment as the metal parts are worn by friction. The addition of water to the process requires availability of a sufficient water supply to maintain the process and also requires a drying process before the desired product can be used. Chemical cleaning, such as is common in the foundry industry results in less than optimal recovery, approximately fifty percent.

All of these problems are resolved by the claimed invention. The rotating action necessary to grind the granular particles occurs in a cavity between the conveyor belts. The granular particles do not come in contact with any other surfaces, such as metal, during the rotating action. The claimed invention provides a high yield of separation of materials which in turn provides a high yield of the desired end product, resulting in almost complete recovery of the desired product. Very little damage is done to the granular particles because the materials only comes in contact with the non-metal surfaces, such as rubber, and is not crushed against metal surfaces.

It is a primary object of this invention to provide a machine and process for grinding granular material using conveyor belts.

It is a further object of this invention to provide a machine and process which can grind granular material by a cold and dry process with use of relatively low amounts of energy.

It is a still further object of this invention to minimize damage to the desired end product.

It is yet another object of this invention to provide an efficient low initial cost and low maintainance cost system for attaining a high yield end product which overcomes the deficiencies of the present systems.

DISCLOSURE OF THE INVENTION

I have developed a grinding process and machine for processing or treating a plurality of different granular particles. My system, using two flexible continuously moveable conveyor belts, can be adapted to and treat a plurality of different granular materials. The conveyor belts form a cavity. A rotating action provides the basis for the processing of the material. The rotatory action is a function of the distance between the conveyor belts that forms the cavity which allows friction between the granular particles and the inner surfaces of the belts as the material is transported along the system.

Simple adjustments to achieve the predetermined condition vary the distance between the conveyor belts also vary the tension of each belt. Additionally, the speed and direction of the belts may be varied. These adjustments provide the versatility to process different types of granular material. For example, silicia sand can be reclaimed from additives, grains can be separated from dirt, rice can be hulled and polished, and pecans can have their outer layer removed and be polished. All of these processes can be accomplished on the same machine.

Processing granular particles has resulted in substantial damage to equipment because of the friction of the granular material against metal surfaces. My system completely resolves this problem by processing the granular particles in a cavity between conveyor belts. No spillage occurs even with movement of the granular material in various planes, such as horizontally, vertically or diagonally. Further, the friction of the granular material against a metal surface can damage the desired end product or unnecessarily reduced its size. This problem is also resolved because the granular material only comes in contact with non-metal surfaces.

DESCRIPTION OF THE PREFERRED EMBODIMENT

Figures 1, 2:
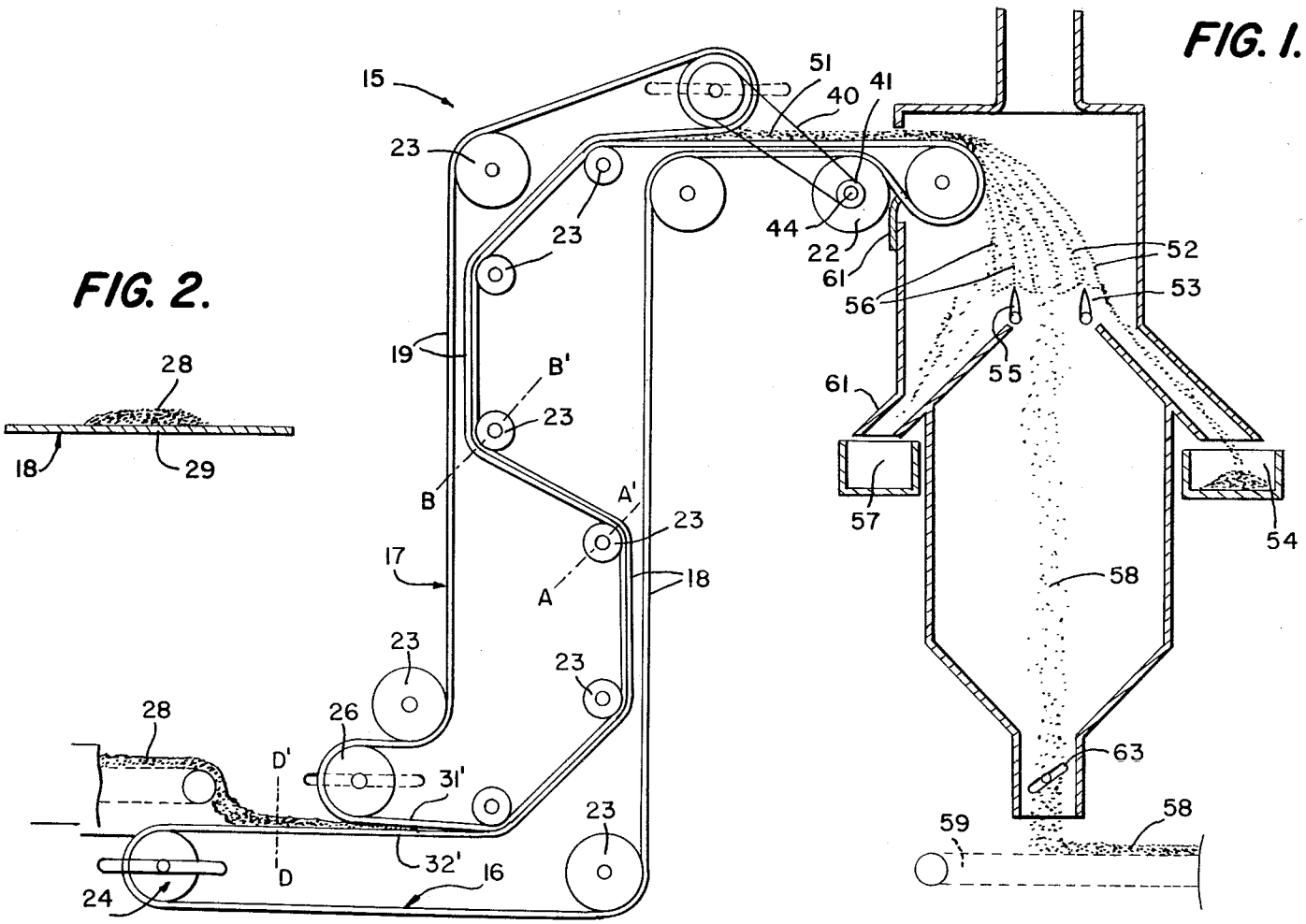
FIG. 1 is a schematic view of the conveyor belt assembly system showing the processing of granular particles.
FIG. 2 is a cross-sectional view of the first conveyor belt along line D—D of FIG. 1.

The conveyor belt assembly system 15 as shown in FIG. 1, is characterized by the combination of two pulley systems 16 and 17 and two flexible continuously movable conveyor belts 18 and 19 to form a grinder. The first pulley from an outside power means, and an energy transmitting pulley 22 that turns in opposite direction from the drive pulley 20. The drive pulley 20 is guided in its path by a plurality of rollers 23 of varying or similiar sizes arranged along the length of its path and by a take up pulley 24. A first conveyor belt 18 is positioned around and driven by the first pulley system 16. A second pulley system 17 is driven by drive pulley 25 which receives energy from an outside power means. The drive pulley 25 is guided along its path by take up pulley 26 and a plurality of rollers 23 of similiar or varying sizes arranged along the length of its path. A second flexible continuously moveable conveyor belt 19 is positioned around and driven by the pulley system 17.

Figure 3:
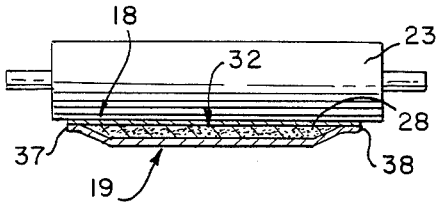
FIG. 3 is a cross-sectional view of the belts along line A—A of FIG. 1.
Figure 4:
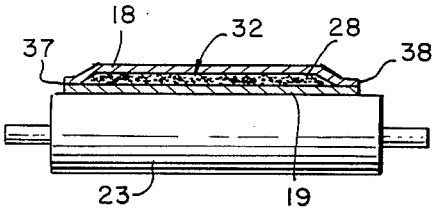
FIG. 4 is a cross-sectional view of the belts along line B—B of FIG. 1.
Figure 8:
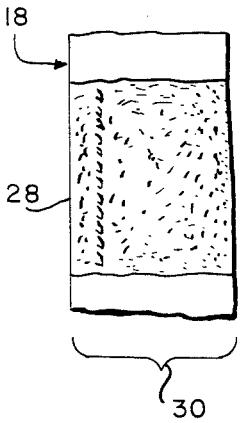
FIG. 8 is a top view of a portion of the first conveyor belt.
Figure 5:
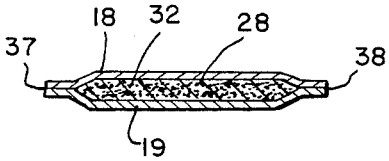
FIG. 5 is a cross-sectional view of the belts alng line C—C of FIG. 1.

First pulley system 16 and second pulley system 17 are so constructed and arranged as to allow the first conveyor belt 18 and second conveyor belt 19 to be brought into engagement with each other along a portion of their lengths. A feeder portion 27 is positioned at one end of the conveyor belt assembly system 15 to allow granular particles 28 to be introduced between the conveyor belts. The granular particles 28 are deposited onto the center 29 of the first conveyor belt 18 as shown in FIGS. 1 and 2 and are moved along first conveyor belt 18 bringing the second conveyor belt 19 in engagement with the first belt 18. The granular particles 28 are deposited in the center 29 of the first conveyor belt 18 and are distributed along the width 30 of the conveyor belt 18 as the granular particles 28 travel along the length of its path as shown in FIG. 8. The thickness of the granular particles 28 in cavity 32 effects the rotating action of the material as it is transported. The cavity 32 is spaced apart a critical distance to cause the granular particles 28 to rub against each other. The thickness of the ribbon of granular particles in the cavity 32 is critical when grinding the materials to achieve the predetermined condition desired. The granular particles 28 that are introduced into the center 29 of the first belt 18 are retained there because of the shape of the first and second conveyor belts when they are brought into engagement with each other. FIGS. 3, 4 and 5 are cross-sections of the conveyor belts along lines A—A, B—B and C—C, respectively. FIG. 3 shows a linear shaped conveyor belt 18 and a concave shaped second conveyor belt 19 circumscribing the granular particles 28 in cavity 32 with roller 23 positioned above first belt 18. FIG. 4 shows a convex shaped first belt 18 and a linear shaped second conveyor belt 19 circumscribing the granular particles 28 in cavity 32 with roller 23 positioned below second belt 19. FIG. 5 shows a convex shaped first belt 18 and a concave shaped second belt 19 with granular shaped particles 28 in cavity 32. The belts are in contact along their outer edges 37 and 38 and are separated in their midsection by the presence of the granular particles 28 in cavity 32. The contact between the outer edges 37 and 38 of the belts 18 and 19 is maintained by the plurality of rollers 23 and by adjusting the tension on the first belt 18 and the second belt 19 by means of takeup pulley 24 and takeup pulley 26, respectively.

The granular particles 28 enter the feeder portion 27 is which closely adjacent to first conveyor belt 18. Second conveyor belt 19 may remain stationary, move in the same direction as the first belt or move in the opposite direction. The speed of the each belt is independent is regulated by a power means (not shown) and is a function of the transmission belt 40, and pulley 41 and pulley 42. Pulley 41 and pulley 42 may have different diameters. Pulley 41 is attached to power transmitting pulley 43 by means of a shaft 44. Pulley 42 is attached to drive shaft 45.

Moving the granular particles 28 in cavity 32 between belts 18 and 19, results in friction between the adjacent particles and between the particles and the inner surfaces of the belts. The smaller particles are dislodged from the larger particles. This occurs because of the rotating and grinding action as the granular particles 28 are moved along the length of the belts. The granular particles 28 are conveyed without spillage in any direction including horizontally, vertically and diagonally. It would be obvious to someone skilled in the art to vary the lengths of the mated conveyor belts, the material the belts are made of and the pulley system to accomodate a wider variety of granular materials. A variety of materials can be ground to achieve predetermined conditions. Examples of granular materials that may be processed by this system include:

(a) reclaiming silicia sand resulting as a waste product from the molding operation in the foundry industry;

(b) cleaning granular mineral materials found in natural deposits in a mixture of elements such as clay feldspar and others;

(c) hulling and polishing rice;

(d) dislodging natural dust that adheres to grains such as corn and wheat, in loose form, and removing the dust before the material is discharged to avoid excessive dust from accumulating in grain elevators and silos to avoid fires;

(e) to remove the outer cover or layer of pecans, clean and polish the surface of the shell as well as reduce the thickness of the shell under controlled conditions and separate the product from the residue.

The conveyor belt assembly system 15 includes a discharge portion 50. Second conveyor belt 19 moves out of engagement with first belt 18. The mixture of particles 51 are discharged from the first belt 18 as it returns over drive pulley 20. A magnetic pulley could be used to separate magnetic metals from the mixture 51. The mixure 51 is discharged with sufficient force to cause the material to cascade as it is discharged from from first belt 18. The speed of first belt 18 could be adjusted to obtain the desired result. The speed of the discharged particles combined with the force of gravity and the air resistance cause a cascading effect. Particles of greater weight 52 can be separated by means of a first separator blade 53 and allow the particles to collect in a container 54. A second separator blade 55 may be positioned to separate particles of lower weight 56 with their collection in container 57. The remaining particles, the desired end product 58 is collected on a conveyor belt 59 for easy transport. Separator blades 53 and 55 are adjustable to accomodate a plurality of different weight granular materials. A plurality of separator blades could be incorporated in the present system. The very fine dust may be scrapped from the first conveyor belt 18 by a scrapper means 61 and collected in container 57. Additionally, a certifugal blower 63 could be positioned to remove dust by an uprising column of air and conveyed through suction duct 64.

Figure 6:
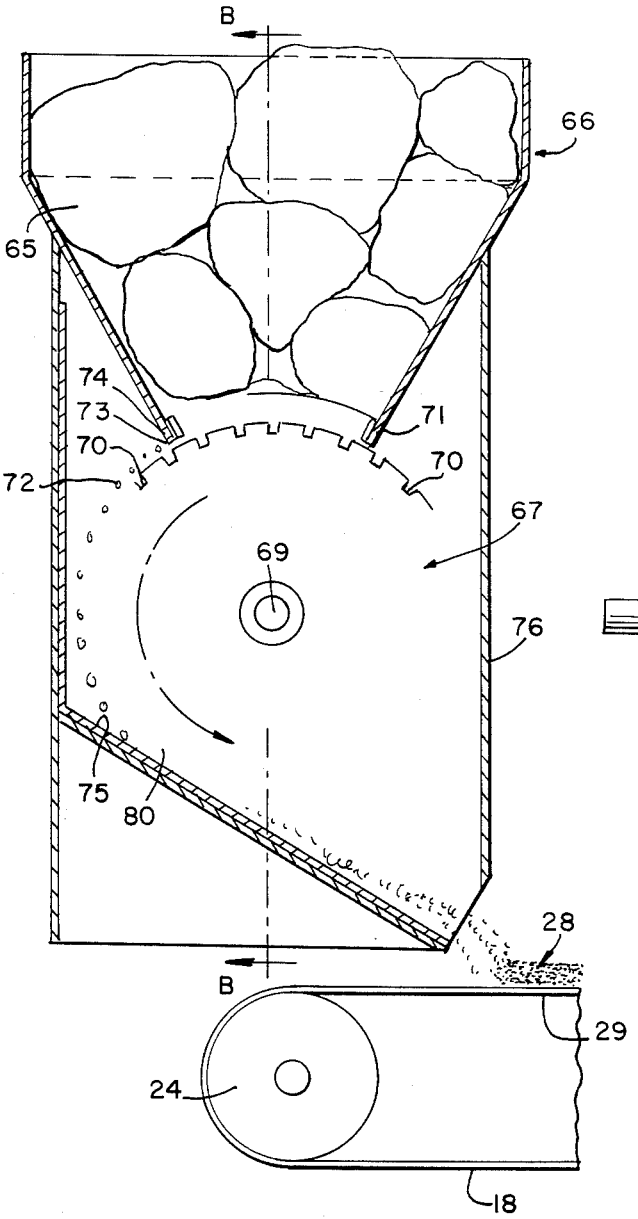
FIG. 6 is a sectional lateral elevated view of the disintegrtor.
Figure 7:
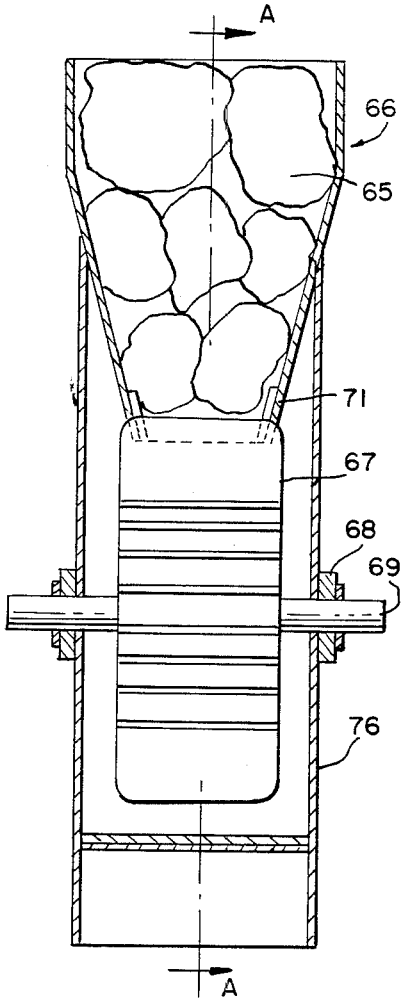
FIG. 7 is a sectional fron view of the disintegrator.

The efficient and effective operation of this process is dependent upon the rotating action as the granular particles 28 are conveyed in cavity 32 along and between belts 18 and 19. The dimensions of the granular particles 28 may require reduction as a preliminary step to being processed, since many times the granular material to be processed in its original form, or because of its use in industry, is in lumps. A great number of grains are bonded by material binders such as clay or by residues and additives such as resins, clays and starches i.e. sodium silicate. To reduce the size of the lumps to the maximum desired dimensions a disintegrator may be used. Reduction of the lumps to 64 mm. (approximately ¼ inch) has beeen found to be sufficient reduction to obtain efficient and effective processing. An example of a disintegrator that is readily adapted for use in combination with the conveyor belt assembly system 15 is shown in FIGS. 6 and 7. The lumps 65 are deposited in a charging hopper 66. The deposited lumps 65 come in contact with a cylindrical rubber rotor 67 which is mounted on shaft 69 and supported by bearings 68. The rotor 67 is positioned in the hopper 66 by shaft 69. A power means (not shown) for operating said disintegrator provides the necessary rotating movement. The rotor 67 has on its surface were it makes contact with the lumps 65, grooves 70 that provide forceful friction against rubber lip 71 to break the lumps into smaller diameter and to dislodge particles from the desired end product. The reduced lumps 72 are channeled through adjustable space 73 formed between the lower edge 74 of the hopper 66 and the rotor 67. The lower edge 74 of the hopper 66 is lined with a rubber lip 75 to prevent damage to the material from contact with metal surfaces. The reduced particles 72 are collected in a structural box 76 and guided to the point of discharge 77. The box 76 in combination with the rotor 67 further reduces the size of the lumps along space 80 as the granular material moves toward discharge point 77. The reduced granular material 28 is then loaded or introduced into the center portion 29 of first conveyor belt 18 to be processed.

I claim:

1. A grinding process comprising the steps of providing a grinding cavity formed between two opposed flexible continuously movable belts which are in contact with each other at least along their transverse edges forming a tubular like spill free conveyor, adjusting said belts relative to each other to form a cavity of predetermined size based on the type of granular particles to be ground, grinding said particles by imparting a rotating action upon the outer surface of the particles while the particles are in said cavity, said rotating action causing said particles to rub and grind against each other and said belts to a predetermined condition, said rotating action being effected by moving said belts relative to one another at different speeds, said particles being conveyed along said belts without spillage in any direction and without any undesired contact with foreign surfaces due to said belts being in contact with each other, and discharging the ground material from said cavity.

2. The process as defined in claim 1 including the further step of separating said materials as they are discharged from said cavity.

3. The process as defined in claim 2 including the step of separating said materials by positioning at least two separator blades in the path of said discharged particles, one blade positioned to separate particles of lower weight, a second blade to separate particles of higher weight.

4. The process as defined in claim 2 including the step of reducing the dimensions of said granular particles before introducing said material into the cavity between said belts.

5. The process defined in claim 4 including the steps, (a) scraping the dust from said conveyor belts, and, (b) collecting said dust in a collection container.

6. The process as defined in claim 5 wherein said separating step including adjusting said separator blades and varying the speed of said conveyor belts to optimize the separation of said material.

* * * * *